United States Patent [19]

Adler

[11] Patent Number: 4,648,597

[45] Date of Patent: Mar. 10, 1987

[54] BICYCLE SUPPORT DEVICE

[76] Inventor: Percy Adler, 276 Cedar Avenue, Richmond Hill, Ontario, Canada

[21] Appl. No.: 769,292

[22] Filed: Aug. 26, 1985

[30] Foreign Application Priority Data

Aug. 27, 1984 [CA] Canada ..... 461894

[51] Int. Cl.[4] ..... A63B 69/16

[52] U.S. Cl. ..... 272/73; 280/296

[58] Field of Search ..... 280/296, 293; 272/73.1, 272/73; 211/22; 248/121

[56] References Cited

U.S. PATENT DOCUMENTS

| | | | |
|---|---|---|---|
| 598,705 | 9/1897 | Dwyer | 272/73.1 |
| 2,805,860 | 9/1957 | Littig | 272/73.1 |
| 3,866,908 | 2/1975 | Hangler | 272/73.1 |
| 4,021,034 | 5/1977 | Olesen | 272/73.1 |
| 4,322,070 | 3/1982 | Jordaan | 272/73 |

FOREIGN PATENT DOCUMENTS

| | | | |
|---|---|---|---|
| 906520 | 8/1972 | Canada . | |
| 925893 | 5/1973 | Canada . | |
| 938948 | 12/1973 | Canada . | |
| 1164021 | 3/1984 | Canada . | |
| 580636 | 12/1924 | France | 211/22 |
| 616850 | 4/1980 | Switzerland | 272/73.1 |

*Primary Examiner*—John A. Pekar

*Attorney, Agent, or Firm*—Rogers, Bereskin & Parr

[57] ABSTRACT

A bicycle support device is provided for supporting a bicycle, so it can be used as a stationary exercise device. It has a base member, and a vertical member extending up from the base. The frame of a bicycle is supported on a support bracket on top of the vertical member, and is held by a clamping member. A friction roller is rotatably mounted to the vertical member. This device thus can support the bicycle with the rear wheel engaged by the roller.

21 Claims, 2 Drawing Figures

BICYCLE SUPPORT DEVICE

Figure 1:
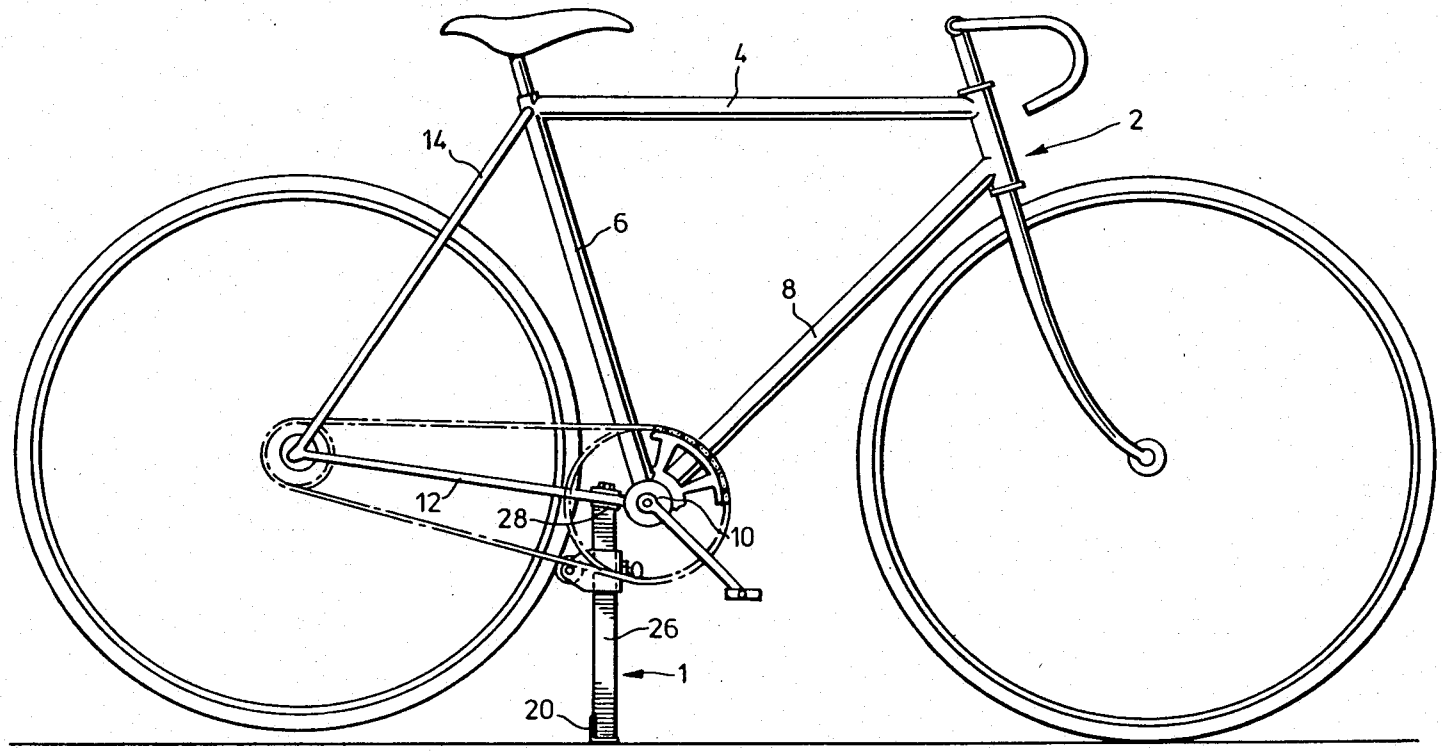

This invention relates to a bicycle support device.

Presently, there is a demand for a device that will enable a conventional bicycle, or other cycle, to be converted to a stationary exercise device. Whilst bicycling provides a good form of exercise, various reasons, such as inclement weather or heavy urban traffic conditions, can make it undesirable to go bicycling. Instead, a user frequently wishes to exercise on his bicycle in a stationary position. To do this, some sort of device is required which will support the bicycle and provide some element of retardation to absorb the user's energy input.

Many proposals have been made for supports or conversion attachments for bicycles. An early proposal is found in U.S. Pat. No. 2,805,860, and other proposals are found in U.S. Pat. Nos. 4,021,034 and 4,322,070. Further proposals for these type of devices can be found in Canadian Pat. Nos. 906,520; 925,893; 938,948; and 1,164,021. All of these devices are relatively complex, and hence quite costly. Further, they frequently are cumbersome and awkward to fit and remove from a bicycle, and many of them require a large amount of space for storage.

Thus, for example, the proposal in U.S. Pat. No. 4,322,070 shows a relatively complex stand construction, which supports the bicycle at the rear axle shaft. It includes a friction roller for engaging the rear wheel of the bicycle and a knob and linkage arrangement for actuating the friction roller.

Canadian Pat. No. 1,164,021, which is a recent suggestion for solving this problem, suggests a complex mechanism and structure. It, again, has a stand which supports either end of the rear axle shaft. It also has a flywheel rotatably mounted to an extension of the support frame. A mechanism including springs, shafts and a hand wheel attached to a threaded shaft is provided for applying the flywheel to the rear wheel of the bicycle. The overall construction is thus very complex, would take a large amount of time to install or remove, and would occupy a lot of space in storage.

What is required is a simple, compact device, which can support a bicycle for use as a stationary exercise machine. The device should be capable of being quickly and readily attached or removed from the bicycle.

According to the present invention, there is provided, for a bicycle having a frame including rear forks extending rearwardly from a crank bracket, a bicycle support device comprising: a base member of sufficient width to provide a stable support for a bicycle; a vertical member secured to the base member and extending upwardly therefrom; a first, support bracket secured to the top of the vertical member for supporting the frame on the rear forks, between the rear wheel and the crank bracket of a bicycle; a clamping member attachable to the first, support bracket for clamping rear forks to the support bracket; and a friction roller rotatably mounted to the vertical member for engaging the rear wheel of a bicycle.

The device can include a second bracket, for the friction roller, which enables the location of the friction roller to be adjusted.

The bicycle support device just defined can be simple and compact. It includes a small number of components, and thus should be economical to manufacture. Since it is only secured to the bicycle at one location, namely, to the rear forks adjacent to the crank bracket, it can be quickly and simply attached or detached from the bicycle frame. After attachment, the friction roller can be readily adjusted, to provide the required degree of friction on the rear wheel. A user can then mount the bicycle and ride it in the normal fashion. As the rear wheel is held off the ground, the energy of the user or rider expended whilst pedalling is absorbed by the action between the friction roller and the tire of the rear wheel.

Alternatively, if no adjustment is available for the friction roller, the torque required of the user can be varied by using the gears of the bicycle. It is expected that, for a ten-speed bicycle, this should provide adequate variation in the resistance effect.

In all prior devices, the bicycle has been supported at the rear axle shaft. The present bicycle support device makes use of the realization that the bicycle can be supported at or adjacent the crank bracket. The frame of the bicycle provides a triangulated structure, which is strong enough for a support to be provided adjacent the crank bracket. Note that a support provided midway along any of the tubes of the frame would likely impose excessive bending stresses on the tubes. As the support device of the present invention moves the rear support location forward from the rear axle, the portion of the load taken by the front axle is reduced, and the majority of the load will be taken by the support device. This has been found to be satisfactory.

The clamping member can be relatively narrow, so that when rotated through 90°, it can pass between the two forks during assembly and dis-assembly. This enables the device to be attached and detached, without fully removing the clamping member.

Figure 2:
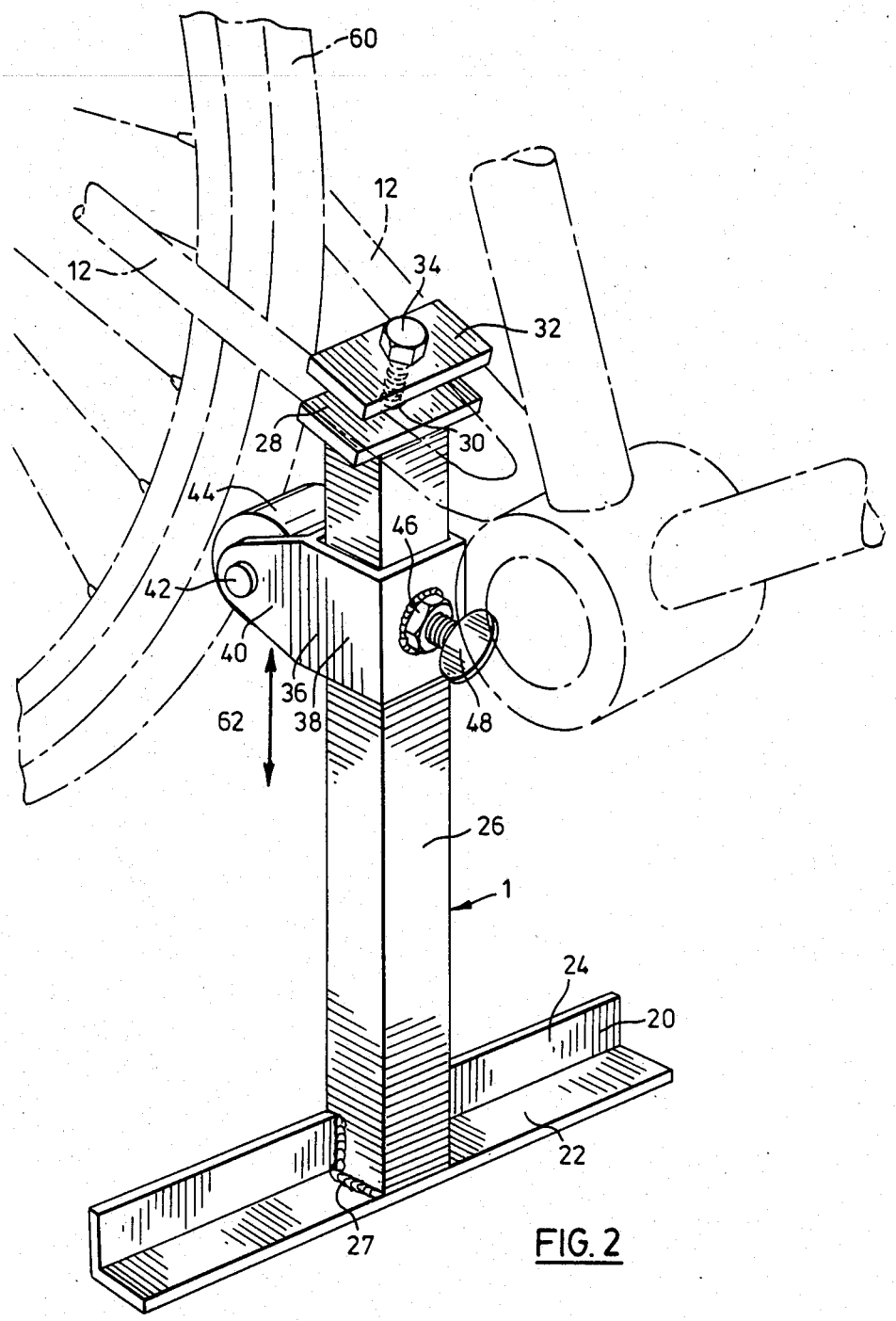

For a better understanding of the present invention, and to show more clearly how it may be carried into effect, reference will now be made, by way of example, to the accompanying drawings, which show a preferred embodiment of the present invention, and in which:

FIG. 1 shows a side view of a bicycle supported on a bicycle support device according to the present invention; and FIG. 2 shows a perspective view of part of the bicycle of FIG. 1 and of the support device.

In FIG. 1, a bicycle support device is generally indicated by the reference 1, and a bicycle is indicated by the reference 2. In known manner, the bicycle 2 includes a frame 4 having a vertical tube 6 and a front tube 8, both of which extend from a crank bracket 10. Extending rearwardly from the crank bracket 10 are two rear forks 12. The rear ends of the forks 12 are braced by further tubes of small section 14. Other elements of the bicycle 2 are also conventional, and will not be described in greater detail here, as they form no part of the present invention.

With reference to FIG. 2, the bicycle support device 1 has a base member 20, which is an angle section, having a horizontal limb 22 and a vertical limb 24. A vertical member 26 is a square section hollow tube, and as indicated at 27, it is welded to the base member 20, both of the base member 20 and the vertical member 26 being formed from steel.

At the top of the bicycle support device 1, there is a first, support bracket 28. In this embodiment, the bracket 28 is a rectangular plate of sufficient dimension to provide support for the forks 12. If desired, this first, support bracket 28 could be provided with grooves corresponding to the forks 12, although this may not be practical where a support device is intended for use with a number of different bicycles. The first, support bracket 28 is welded (not shown) to the upper end of the vertical support member or tube 26, and is inclined slightly to the horizontal, as most clearly shown in FIG. 1. The support bracket 28 is provided with a threaded bore 30. Alternatively, if the bracket 28 is not of sufficient thickness to form an adequate thread, a nut or other threaded member could be welded to its underside within the vertical member 26.

The clamping member 32 is formed as a rectangular plate, of similar dimensions to the first, support bracket 28 It includes a central opening or bore corresponding to the threaded bore 30. This enables a bolt 34 to clamp the clamping member 32 and forks 12 to the support bracket 28.

A second bracket 36 is formed from sheet steel and includes a square body section 38 corresponding to the outer profile of the vertical member 26. Two side limbs 40 extend rearwardly. A shaft or axle 42 extends between these side limbs 40, and a roller 44 is rotatably mounted on the shaft 42 in known manner. The roller 44 is formed from steel and has a ground, relatively smooth surface finish. At the front of the second bracket 36, a threaded member, such as a nut 46 is welded, and a threaded locking member 48 is provided. Here the locking member 48 includes a head which can be gripped by hand.

In use, to attach the support device 1 to a bicycle 2, the clamping member 32 is first of all removed, by removing the bolt 34. (For frames with adequate clearance, it may be possible to loosen the member 32 and pass it between the forks 12). The device 1 is then positioned at a desired location. The frame 4 of a bicycle 2 is then located on top of the first, support bracket 28, with the forks 12 resting on it. The clamping member 32 and bolt 34 are replaced. Following this, the bolt 34 is tightened, to securely clamp the frame in position. All that is then required is to adjust the roller 44, so that it provides the required force against a rear tire 60 of the bicycle. This is simply achieved by loosening the second bracket 36 by means of the fastening element 48, and adjusting the position of the second bracket 36 vertically as indicated by arrow 62. Vertical movement of the roller 44 will effectively move it towards and away from the periphery of the rear wheel 60, thereby altering the pressure between the roller 44 and the wheel 60. This enables the effective friction provided by the friction roller 44 to be adjusted.

The device 1 thus supports the bicycle 2, with its rear wheel 60 clear of the ground, the front wheel still resting on the ground. With the friction roller 44 adjusted, a user can mount the bicycle 2 and then ride it in the usual way. As mentioned in the preceding paragraph the resistance can be varied by altering the position of the friction roller. Alternatively, the resistance can simply be varied using the gears (not shown) on the bicycle. The rear wheel 60 will rotate, and pedalling effort provided by the user will be absorbed by the roller 44.

Various modifications are possible within the broad concept of the present invention, and some of these are mentioned, by way of example, below. The vertical member 26 could be provided with markings, to indicate the position of the roller 44. This would facilitate setting up the roller 44 in the same position each time. It could also help determine the effective effort required for any particular position of the roller 44, so that the roller 44 can be set up as desired for each exercise session. Also, the roller 44 could be provided with a number of different finishes. Preferably, the finishes are such as to provide sufficient friction between it and the tire of the rear wheel, without wearing the tire.

The base member 20 and the vertical member 26 could have a number of different profiles. In particular, the base member 20 could be an inverted T-section, whilst the vertical member 26 could be of circular section. Also, the width of the base member 20 should be chosen, to be sufficiently wide for its intended use. It should be wide enough so that in conjunction with the additional support point provided by the front wheel, the bicycle is stable. Thus, in general, the larger the bicycle for which it is intended, the wider the base member 20 needs to be.

The support device can be formed from a variety of materials; such as steel or aluminum. Also, fibreglass or a plastic could be used. Also, the device could be formed by moulding or casting in one piece, or by assembling, eg. by welding, all the separate components.

Instead of employing a bolt 34 which is screwed into a thread in the lower plate 28, a threaded stud can be welded to plate 28 to project upwardly therefrom and a nut which threads onto the threaded stud can be used to clamp upper plate 32 on the forks 12.

Instead of bracket 36 encircling the vertical member 26, aligned vertically extending slots can be provided in the forward and rear faces of vertical member 26 and a threaded stud can be welded to the rear portion of bracket 36 to project forwardly through the slots. A wing nut can then be threaded onto the threaded stud where the stud projects from the forward face of vertical member 26, to clamp the bracket 36 at a desired position on the vertical member 26. The range of vertical movement of the bracket 36 will then be limited by the height of the aligned vertical slots in the vertical member 26. Where this arrangement is used, the side faces of the bracket 36 need extend forwardly over the side faces of the vertical member 26 only sufficiently to provide a secure guide for the bracket 36.

I claim:

1. A bicycle support device for use with a bicycle having a frame including rear forks extending rearwardly from a crank bracket, the bicycle support device comprising: a base member of sufficient width to provide a stable support for a bicycle; a vertical member extending upwardly from the base member; a first, support bracket secured to the top of the vertical member for supporting the frame at the rear forks between the rear wheel and the crank bracket, with the rear wheel clear of the ground; a clamping member attachable to the first, support bracket for clamping rear forks to the support bracket; a second bracket movable mounted on the vertical member; and a friction roller rotatably mounted to the second bracket for engaging the rear wheel of a bicycle.

2. A bicycle support device as claimed in claim 1, wherein the base member is elongated and is arranged so that, in use, it extends transversely of a bicycle.

3. A bicycle support device as claimed in claim 2, wherein the base member has an L-shape cross-section.

4. A bicycle support device as claimed in claim 1, wherein the vertical member is of uniform cross-section.

5. A bicycle support device as claimed in claim 4, wherein the vertical member has a hollow square cross-section.

6. A bicycle support device as claimed in claim 1, wherein the first support bracket is formed as a rectangular plate.

7. A bicycle support device as claimed in claim 6, wherein the clamping member is formed as a rectangular plate.

8. A bicycle support device as claimed in claim 6, wherein the first, support bracket has grooves for rear forks of a frame.

9. A bicycle support device as claimed in claim 7, wherein the first, support bracket and the clamping member both have grooves for rear forks of a frame.

10. A bicycle support device as claimed in claim 7, wherein the first, support bracket includes a threaded bore, the clamping member includes a plain bore, and a bolt is provided for passing through the clamping member and engaging the threaded bore of the first, support bracket, to clamp the clamping member and rear forks of a bicycle to the first support bracket.

11. A bicycle support device as claimed in claim 7, wherein the clamping member is sufficiently narrow to enable it to pass between the forks of a bicycle adjacent the crank bracket.

12. A bicycle support device as claimed in claim 1, wherein the second bracket encircles the vertical member.

13. A bicycle support device as claimed in claim 1, wherein the vertical member has a hollow square cross-section and wherein the second bracket encircles the vertical member, and includes means for locking it to the vertical member.

14. A bicycle support device as claimed in claim 13, wherein the second bracket includes two side arms extending rearwardly, and a shaft extending between the side arms, with the roller being rotatably mounted on the shaft.

15. A bicycle support device as claimed in claim 12, wherein the means for locking the second bracket to the vertical member includes a threaded bolt engaging a threaded bore of the second bracket.

16. A bicycle support device as claimed in claim 1, wherein the friction roller has a ground, cylindrical surface for engaging the rear wheel of a bicycle.

17. A bicycle support device as claimed in claim 1, wherein the base member, the vertical member, the first support bracket, the second bracket and the clamping member are formed from steel.

18. A bicycle support device as claimed in claim 1, wherein the base member, the vertical member, the first, support bracket, the second bracket and the clamping member are formed from Aluminum.

19. A bicycle support device as claimed in claim 17 wherein the base member, the vertical member, and the first, support bracket are integrally formed as one piece.

20. A bicycle support device for use with a bicycle having a frame including rear forks extending rearwardly from a crank bracket, the bicycle support device comprising: a base member of sufficient width to provide a stable support for a bicycle; a vertical member extending upwardly from the base member; a first, support bracket secured to the top of the vertical member for supporting the frame at the rear forks between the rear wheel and the crank bracket, with the rear wheel clear of the ground; a clamping member attachable to the first, support bracket for clamping rear forks to the support bracket; a second bracket, which encircles the vertical member and has a profile corresponding to the exterior section of the vertical member, and which includes locking means for locking the second bracket to the vertical member; and a friction roller rotatably mounted to the second bracket for engaging the rear wheel of a bicycle.

21. A bicycle support device for use with a bicycle having a frame including rear forks extending rearwardly from a crank bracket, the bicycle support device comprising: a base member of sufficient width to provide a stable support for a bicycle; a vertical member extending upwardly from the base member, a first, support bracket secured to the top of the vertical member for supporting the frame at the rear forks between the rear wheel and the crank bracket, with the rear wheel clear of the ground, a clamping member attachable to the first, support bracket for clamping rear forks to the support bracket; a second bracket which is slidably mounted on the vertical member and comprises a body section which encircles the vertical member and has an internal section corresponding to the exterior section of the vertical member, two side arms extending rearwardly from the body section, and a shaft extending between the side arms, with the body section including a threaded bore; a threaded bolt engaging the threaded bore of the body section for locking the second bracket to the vertical member; and a friction roller rotatably mounted on the shaft of the second bracket and including a ground, cylindrical surface for engaging the rear wheel of a bicycle.

* * * * *